US006154619A

United States Patent [19]

Boockholdt et al.

[11] Patent Number: 6,154,619

[45] Date of Patent: Nov. 28, 2000

[54] APPARATUS AND METHOD FOR DETECTING THE STATE OF A CONSUMABLE PRODUCT SUCH AS A REPLACEABLE TONER CARTRIDGE

[75] Inventors: Darius Boockholdt, Eagle; Quintin T. Phillips, Boise, both of Id.

[73] Assignee: Hewlett-Packard Company, Palo Alto, Calif.

[21] Appl. No.: 09/428,585

[22] Filed: Oct. 27, 1999

[51] Int. Cl.[7] ..... G03G 15/00

[52] U.S. Cl. ..... 399/24; 399/31; 399/36

[58] Field of Search ..... 399/12, 13, 24, 399/25, 26, 31, 36

[56] References Cited

U.S. PATENT DOCUMENTS

| | | | |
|---|---|---|---|
| 5,038,173 | 8/1991 | Kusumoto | 399/13 |
| 5,103,259 | 4/1992 | Saitoh et al. | 399/13 |
| 5,239,313 | 8/1993 | Marko et al. | 346/108 |
| 5,625,269 | 4/1997 | Ikeda | 318/696 |
| 5,634,169 | 5/1997 | Barry et al. | 399/12 |
| 5,663,624 | 9/1997 | Callaway | 318/696 |
| 5,793,177 | 8/1998 | Chia | 318/685 |
| 5,812,183 | 9/1998 | Jeran | 347/262 |
| 5,844,394 | 12/1998 | Mushika et al. | 318/696 |
| 5,862,431 | 1/1999 | Christensen | 399/27 |

FOREIGN PATENT DOCUMENTS 3-54577 3/1991 Japan .

*Primary Examiner*—Joan Pendegrass

[57] ABSTRACT

An apparatus is provided for detecting the state of a consumable for a printer. The apparatus includes a consumable cartridge, a drive motor, a current measuring device, memory and processing circuitry. The consumable cartridge has a rotatable member that is carried by the cartridge. The motor is configured to rotate the rotatable member. The current measuring device is associated with the motor, and is operative to measure current flow through the motor. The memory is configured to store a predetermined value corresponding to current flow through the motor, and indicative of a change in state of the rotatable member. The processing circuitry is coupled with the current measuring device and the memory and is operative to determine when the measured current flow corresponds to the predetermined value of current flow. Furthermore, the processing circuitry identifies a state of the consumable cartridge. A method is also provided.

17 Claims, 3 Drawing Sheets

APPARATUS AND METHOD FOR DETECTING THE STATE OF A CONSUMABLE PRODUCT SUCH AS A REPLACEABLE TONER CARTRIDGE

FIELD OF THE INVENTION

This invention relates to consumable products such as laser printer cartridges, and more particularly, to techniques for detecting the state of such consumable products.

BACKGROUND OF THE INVENTION

A number of different printing devices utilize replaceable toner cartridges. For example, laser printers, multiple function peripheral devices (MFPs), and copy machines have been designed with replaceable toner cartridges that enable a user to quickly and efficiently replenish toner when the device exhausts toner from an existing cartridge. One problem associated with the use of replaceable toner cartridges results when a cartridge unexpectedly runs out of toner while a user is attempting to print documents. Oftentimes, a user is not familiar with how to replace the cartridge, is unwilling to replace the cartridge, or is in a hurry to replace the cartridge because of the need to complete the generation of a document output job. Hence, there has been a need to predict the end of life for consumable products such as replaceable toner cartridges, and several techniques are presently known in the field for indicating to a user the need to replace a toner cartridge.

One problem which has previously been addressed involves determining the use state, i.e., whether a toner cartridge is new or used, of an existing toner cartridge. Both laser printers and copiers have implemented use state features. Prior solutions for determining use state of replaceable toner cartridges involve active detection of toner level by one of several techniques such as optical and magnetic sensors, fuses, etc. However, these solutions require that additional hardware be added onto the cartridge, and that a print engine also be designed to accomplish the task. The use of these solutions is understood in the art of printing and copying technologies. However, these solutions add complexity and cost to the product.

Recently, customers have desired the ability to manage consumables, such as toner cartridges for laser printers. In order to manage consumables, particularly in network environments, additional information needs to be obtained about operation of the peripheral device, or printer. The ability to determine whether a toner cartridge is new or used has become a vital piece of information when managing consumables. If a printer can detect whether a toner cartridge is new or used, consumable management can be enhanced. Without such ability, information necessary to manage consumables is missing, and usage models of toner cartridges become compromised.

Several recent attempts have been made with existing products to monitor whether a cartridge is new or used. One such technique determines toner level largely by counting pixels utilized during successive print jobs. However, such technique does not provide a feedback solution. Hence, the actual level of toner within a toner cartridge is not physically determined. For example, every time a user removes and reinstalls a toner cartridge, as a result of a jam or some other malfunction, the printer is required to prompt the user in order to ask if a new cartridge has just been installed. Assuming the customer answers correctly, the printer is able to correctly count pixels to determine the level of toner remaining with only the added inconvenience of answering being caused to the user or customer. However, if the customer answers this prompt incorrectly, or does not answer at all, then the toner level functionality is rendered inaccurate. Therefore, there exists a present need to provide an improved and low cost technique for accurately monitoring the state of a toner cartridge so that the peripheral device, or printer, has such information available in order to enhance the management of consumables.

Accordingly, there exists a need to detect the state of a consumable, such as a toner cartridge, without adding the expense of active sensing devices, such as sensors and fuses. Furthermore, there exists a need to provide an accurate and low cost technique for determining the operating state of a replaceable toner cartridge in a manner that is not susceptible of operator or user error, or inattentiveness.

SUMMARY OF THE INVENTION

An apparatus and a method are provided for detecting if an installed cartridge is new or used without any added expense of active sensing devices such as sensors and fuses. Furthermore, an apparatus and a method are provided for determining the state of a consumable, such as a toner cartridge.

According to one aspect, an apparatus is provided for detecting the state of a consumable for a printer. The apparatus includes a consumable cartridge, a drive motor, a current measuring device, memory and processing circuitry. The consumable cartridge has a rotatable member that is carried by the cartridge. The motor is configured to rotate the rotatable member. The current measuring device is associated with the motor, and is operative to measure current flow through the motor. The memory is configured to store a predetermined value corresponding to current flow through the motor, and indicative of a change in state of the rotatable member. The processing circuitry is coupled with the current measuring device and the memory and is operative to determine when the measured current flow corresponds to the predetermined value of current flow. Furthermore, the processing circuitry identifies a state of the consumable cartridge.

According to another aspect, an apparatus is provided for detecting the operating state of a toner cartridge. The apparatus includes a drive motor, a torque detection device, a data storage device, and processing circuitry. The motor is configured to communicate with a rotatable member of a toner cartridge, and is operative to rotate the rotatable member. The torque detection device is coupled with the motor, and is operative to measure torque generated by the motor. The data storage device is operative to store at least one target value representative of torque generated by the motor when rotating the rotatable member, and indicative of a change in operating state of the rotatable member. The processing circuitry communicates with the torque detection device and the data storage device, and is operative to compare the measured torque and the target value of torque to determine when a change in operating state of the rotatable member has occurred.

According to yet another aspect, a method is provided for determining the operating state of a replaceable cartridge. The method includes the steps: providing a drive motor configured to drive a rotatable member of the cartridge in rotation and a current measuring device configured to detect current flow through the drive motor when driving the rotatable member; detecting current flow through the drive motor with the current measuring device; comparing the detected current flow with a predetermined value of current flow indicative of a change of operating state for the cartridge; and determining an operating state of the cartridge based upon the compared detected current flow and predetermined value of current flow.

One advantage is the ability to detect the state of a consumable without having to add the additional cost and complexity associated with active sensing devices. Another advantage is provided by being able to detect the state of a replaceable consumable, such as the use state, or the physical condition of at least one component associated with the replaceable consumable.

DESCRIPTION OF THE DRAWINGS

Preferred embodiments of the invention are described below with reference to the following accompanying drawings depicting examples embodying the best mode for practicing the invention.

DETAILED DESCRIPTION OF THE INVENTION

This disclosure of the invention is submitted in furtherance of the constitutional purposes of the U.S. Patent Laws "to promote the progress of science and useful arts". U.S. Constitution, Article 1, Section 8.

Reference is now made in detail to the preferred embodiments of Applicant's invention as illustrated in the accompanying drawings. Although the invention will be described with reference to one or more preferred embodiments, it is understood that this description is not intended to limit the invention to such embodiments, but that the invention is intended to cover equivalents, modifications and variations that fall within the scope of the appended claims. It is also understood that additional details have been provided in this description in order to provide a thorough understanding of Applicant's invention, but that the invention can be practiced without these specific details.

Figure 1:
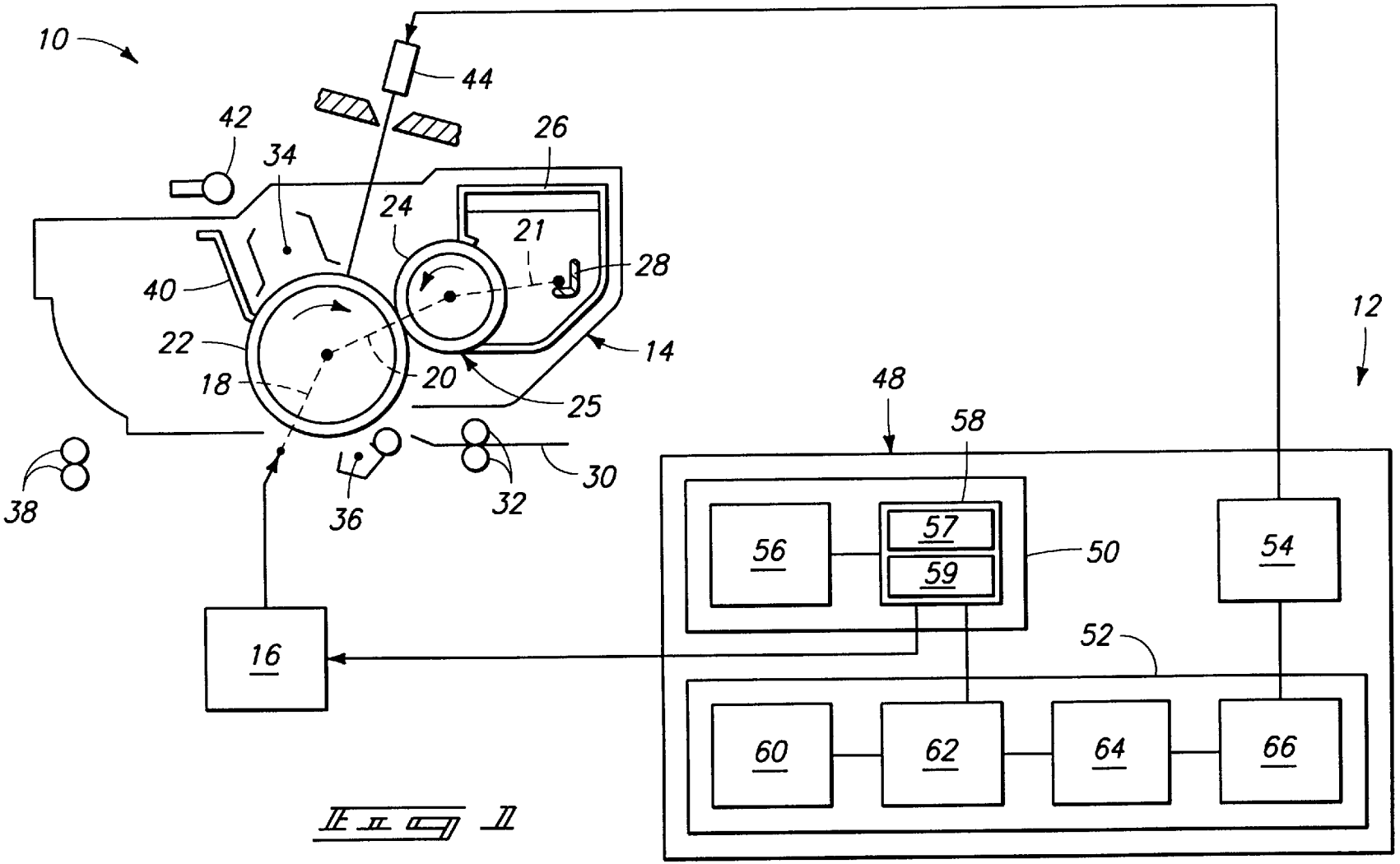
FIG. 1 is a schematic and partial vertical sectional view of a peripheral device in the form of an electrophotographic (EP) printer utilizing an apparatus for detecting the operating state of a toner cartridge according to one implementation of Applicant's invention.

FIG. 1 shows a peripheral device in the form of printer 10 incorporating features in accordance with the present invention comprising an apparatus for detecting the state of a consumable in a printer and identified by reference numeral 12. Detection apparatus 12 includes a drive motor 1 6 and an electronics assembly 48. Apparatus 12 cooperates with a consumable cartridge 14 by way of a first gear train 18 to rotatably drive a photoconductive (PC) drum 22 in rotation during a printing operation. According to one construction, photoconductive (PC) drum 22 is an organic photoconductive (OPC) drum. However, it is understood that other forms of photoconductor drums can be utilized. OPC drum 22 is driven in co-rotation with a developer roll 24 via a second gear train 20. A third gear train 21 drives a plurality of mixing paddles 28 via rotation of developer roll 24. Mixing paddles 28 are positioned within a toner supply reservoir housing 26 in which toner is contained for delivery via developer roll 24 to the surface of OPC drum 22.

As shown in FIG. 1, cartridge 14 is a consumable cartridge configured in the form of a toner cartridge. However, it is understood that consumable cartridge 14 can also be a support structure that carries a photoconductive drum, a housing that carries toner in which is provided at least one mixing paddle, or any other consumable having a rotatable member that is driven in rotation either directly, or indirectly, by drive motor 16, and which can impart resistance that is detectable via drive motor 16 due to changes in operating state associated with the motor and resulting from changes in rotational resistance imparted by the rotatable member.

Figure 2:
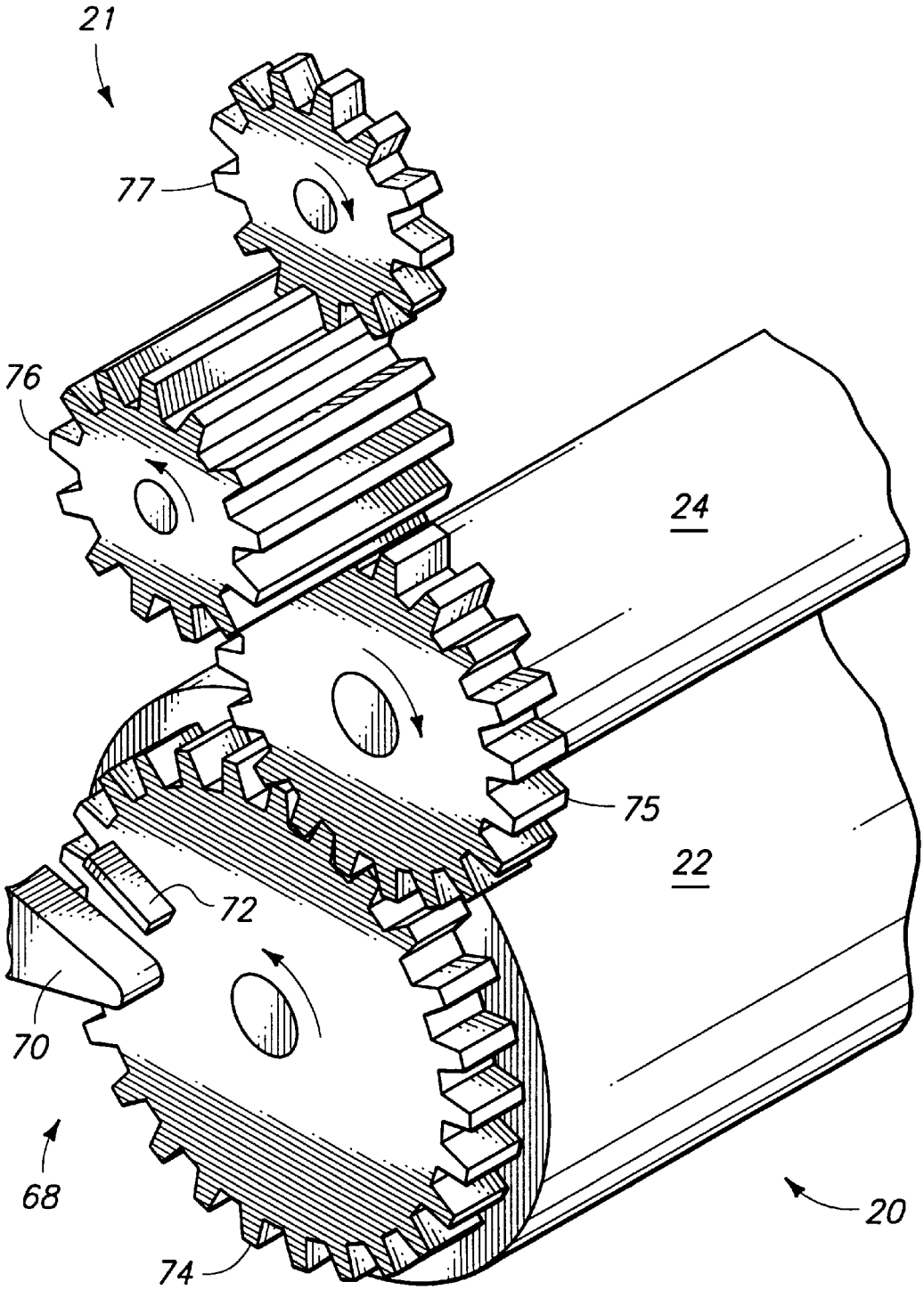
FIG. 2 is an enlarged schematic and partial vertical sectional view of the printer of FIG. 1 illustrating a gear train coupled to an organic photoconductive (OPC) drum of the toner cartridge.

As also shown in FIG. 1, cartridge 14 has a rotatable member 25 which is carried by the cartridge, and which is rotated directly, or indirectly, by drive motor 16. According to one construction, rotatable member 25 is depicted in FIG. 1 in the form of developer roll 24. However, it is also understood that photoconductive drum 22 and paddle 28 are also rotatable members, as well as gears 74–77 (as shown in FIG. 2).

Although this invention is taught with a traditional toner cartridge in which a developer roll is supported for replacement along with toner, it is understood that such invention can be implemented on developer units, within color toner units, and other consumable cartridges wherein not all operating components are carried within the cartridge, but wherein a rotatable member is placed into rotatable engagement with a drive motor of the associated device. Therefore, any device having a rotatable member that is provided for co-rotation in engagement with a drive motor such that torque variations can be monitored at the motor and which enables prediction of the operating status of the rotatable member (or other co-rotating members) is worthy of utilization of Applicant's invention and is considered as being encompassed within the scope of the appended claims.

As shown in FIG. 1, a sheet of paper 30 is delivered via a plurality of supply rollers 32 for delivery against photoconductor drum 22 where an image is transferred thereon. In operation, printer 10 performs a complete cycle of image-forming operations with each complete revolution of photoconductive drum 22 wherein an electrophotographic printer 12 utilizes a solid-state laser 44 which scans across and exposes photoconductive drum 22, creating a latent image on drum 22. Subsequently, powder toner is delivered from housing 26 via developer roll 24 so as to deposit toner along the latent image on drum 22.

As shown in FIG. 1, printer 1 0 performs a complete cycle of image-forming operations with each complete revolution of photoconductive drum 22. Beginning with a process initiation point (not shown) on drum 22, a charging corona, charge wire, charge roller, or other charging device, 34 electrostatically charges the photoconductive drum 22. Subsequently, a combination printer and imaging optics array, or laser, 44 exposes the photoconductive drum 22 with an image light pattern, resulting in selective discharge of the previously uniformly charged area created in the previous step, resulting in an electrostatic image. Toner cartridge 14 then delivers electrostatically charged powder toner particles (either black or colored) to the photoconductive surface on drum 22, developing the photoconductor on drum 22 with the particles selectively adhered or appropriately charged regions. A second, or discharge, corona 36 charges the back side of paper 30 such that toner is transferred from the photoconductive drum 22 onto paper 30 where paper 30 and drum 22 contact in the region of charging corona 36. Subsequently, a fusing station comprising a pair of hot fusing rollers 38 thermally fuses the transferred powder toner onto paper 30. Additionally, a discharge lamp 42 is configured to completely discharge the surface of drum 22 before it is recharged by corona wire 34. Finally, a cleaning station comprising a cleaning blade 40 cleans any residual toner from the surface of photoconductive drum 22, enabling reinitiation of the cycle beginning with the initial process initiation point on drum 22.

In operation, developer, or developing, roll 24 transfers toner from the toner bath within housing 26 onto photoconductive drum 22. Typically, a dry toner is used which consists of fine thermal plastic particles that are impregnated with a ferromagnetic material such as iron. Developer roll 24 contains an internal magnet having a negative pole which attracts the toner. Tribo electric charging results in a negative charge to the particles. Developer roll 24 is electrically biased so as to repel the charged toner onto the image areas on drum 22. In this manner, toner is transferred onto photoconductive drum 22 so as to form a pattern thereon which duplicates an image delivered via laser 44.

As shown in FIG. 1, electronics assembly 48 includes control circuitry 50, formatter 52, and laser-driven controller 54. Typically, control circuitry 50 comprises a control circuitry board containing electronics mounted thereon. Likewise, formatter 52 typically comprises a formatter board containing electronics mounted thereon. Control circuitry 50 includes a data storage device (or programmable memory) 56 and a microprocessor (or processing circuitry) 58. Likewise, formatter 52 includes programmable memory 60, a microprocessor (or processing circuitry) 62, a variable frequency clock 64, and a page buffer 66.

FIG. 2 illustrates a mechanical resistor, or resistance element, 68 provided by second gear train 20 (of FIG. 1). However, it is understood that such feature could be provided by first gear train 18 or third gear train 21, or any other rotatable component associated with toner cartridge 14 (of FIG. 1). More particularly, mechanical resistor 68 is formed by a rigid structural finger 70 that is preferably integrally molded from the toner cartridge housing, and which extends radially inwardly of an endmost surface of gear 74 along the end of photoconductive drum 22. Gear 74 is formed from plastic material from which an integrally formed breakaway tab 72 is directly molded. Rotation of drum 22 via gear 74 by the drive motor and gears (not shown) causes rotation of drum 22 and gear 74 such that tab 72 engages in abutment with finger 70, causing tab 72 to break away therefrom. Although tab 72 is formed on gear 74, it is understood that finger 70 can be provided on gear 74, with breakaway tab 72 being integrally molded from the toner cartridge housing. Even further optionally, tab 72 and/or rigid structural finger 70 can be mounted to any of gears 75–77, or to any other moving member on the toner cartridge capable of imparting a physical resistance that manifests itself as an increase in current used by the drive motor such that the "new state" of a toner cartridge can be detected.

Such mechanical resistor 68 is utilized in order to generate a spike in current draw used by the main drive motor corresponding with an increase in torque needed to rotate the drive motor. Such increase in current draw is detectable by the processing circuitry of Applicant's detection apparatus 12 (of FIG. 1). Accordingly, processing circuitry 58 of FIG. 1 provides a torque detection device 57 that is coupled with the drive motor and is operative to measure torque generated by the drive motor via detection of current draw used by the main drive motor. Hence, processing circuitry 58 also provides a current measuring device 59. As shown in FIG. 2, gear train 20 is shown with a plurality of gears 74–77 coupled together for co-rotation. Gear 74 is mounted to one end of photoconductive drum 22 and gear 75 is mounted to a corresponding end of developer roll 24. Additional gears 76 and 77 comprise additional gears suitable for driving associated components within a toner cartridge. For example, gears 76 and 77 can be used to couple together mixing paddles 28 and developer roll 24, corresponding with third gear train 21. It is understood that the particular size and configuration for gears 74–77 will vary depending upon the diameters of drum 22, roll 24, and the speed with which accompanying components need to be driven. It is understood that gears 74–77 are not necessarily shown in an actual size and configuration, but are shown in simplified form for purposes of illustrating the operation of mechanical resistor 68. For example, gears 74–77 can include sets of reduction gears configured to adjust the relative rotational speeds of respective associated rotating members. Hence, it is understood that individual gears 74–77 can be formed as complex gears having neighboring sections with different diameters configured to impart gear reduction between adjacent co-rotating gears. Accordingly, the specific construction of gears 74–77 is not germane to implementation of Applicant's invention, other than the specific provision of tab 72 so as to impart mechanical resistor 68 features to Applicant's invention.

Details of one construction for a gear train are disclosed in U.S. Pat. No. 5,812,183 according to a construction presently understood in the art. Such U.S. Pat. No. 5,812,183 is herein incorporated by reference as illustrating one construction that is presently understood in the art.

The detection apparatus 12 of Applicant's invention, as depicted in FIG. 1, consists of the ability of printer 10 to measure current drawn by main drive motor 16, and to compare such measured current draw with knowledge and documentation of the characteristic torque/current-life curve for a toner cartridge 14 (of FIG. 1). Upon insertion of a new cartridge into a printer, the printer of FIG. 1 is capable of detecting the presence of the cartridge by any of a number of techniques presently understood in the art, and run a detection scheme that looks at the current drawn by drive motor 1 6 over some length of time. One technique involves monitoring the current drawn by a print engine that is coupled with drive motor 16. When such data is gathered, it is then compared to a characteristic look-up table that is resident within printer 10; for example, within memory 60 of formatter 52 (of FIG. 1).

As shown in FIG. 2, mechanical resistance is imparted when breakaway tab 72 engages with structural finger 70 which generates an artificial spike in rotational resistance of gear train 20 such that the characteristic torque/current curve includes a spike that easily identifies the toner cartridge as being a new toner cartridge. Upon breakage of tab 72, mechanical resistor 68 is disabled, and the normal torque/current curve for the toner cartridge is realized. It is understood that any of a number of mechanical resistors can be substituted for the mechanical resistor 68 of FIG. 2. For example, any of a number of breakaway tabs, brackets, cam resistance, etc. can be used to impart such resistance. The ability to impart such rotational resistance allows the printer to determine if a toner cartridge is in a "new" state or a "used" state. Such information can then be input into any of a number of presently available consumable management modules that are resident within the printer and/or an accompanying host computer (not shown).

In operation, the surface condition of organic photoconductive (OPC) drum 22 becomes critical to the proper functioning of drum 22. Surface rheology of drum 22 is a factor in determining the overall surface condition on drum 22. The surface rheology on drum 22 can be measured via Applicant's invention by monitoring the current required by drive motor 16 when driving drum 22 via gear trains 18, 20 and 21. Monitoring of current drawn by the drive motor can be performed by monitoring the print engine contained on formatter 52. The monitoring of such parameter within the print engine will allow prediction of such factors as the life of photoconductive drum 22, and the surface condition of drum 22.

From early experimental work with a Hewlett-Packard LaserJet 5Si laser printer, it has been shown that the torque required to drive a toner cartridge increases with the age of the toner cartridge. Such toner cartridges include gears as shown in FIGS. 1 and 2 which are used to turn the photoconductive drum 20 , and stirring mechanisms such as mixing paddles 28 (of FIG. 1). This observation did not initially appear intuitively since, near the end of life of a toner cartridge, there is less toner, and thereby less resistance to the stirring mechanisms imparted by mixing paddle 28. Early in life, mixing paddle 28 would be thought to increase the resistance sufficient to increase the required torque at the beginning of usage of a toner cartridge.

Figure 3:
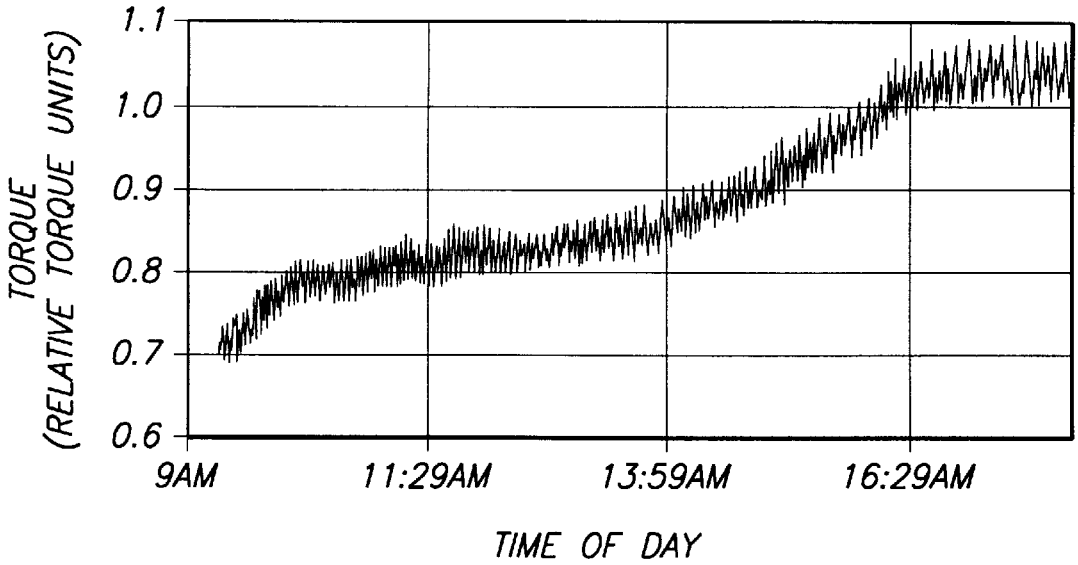
FIG. 3 is a characteristic plot of torque versus time for a continuous print job using a characteristic toner cartridge operating in a continuous print mode.
Figure 4:
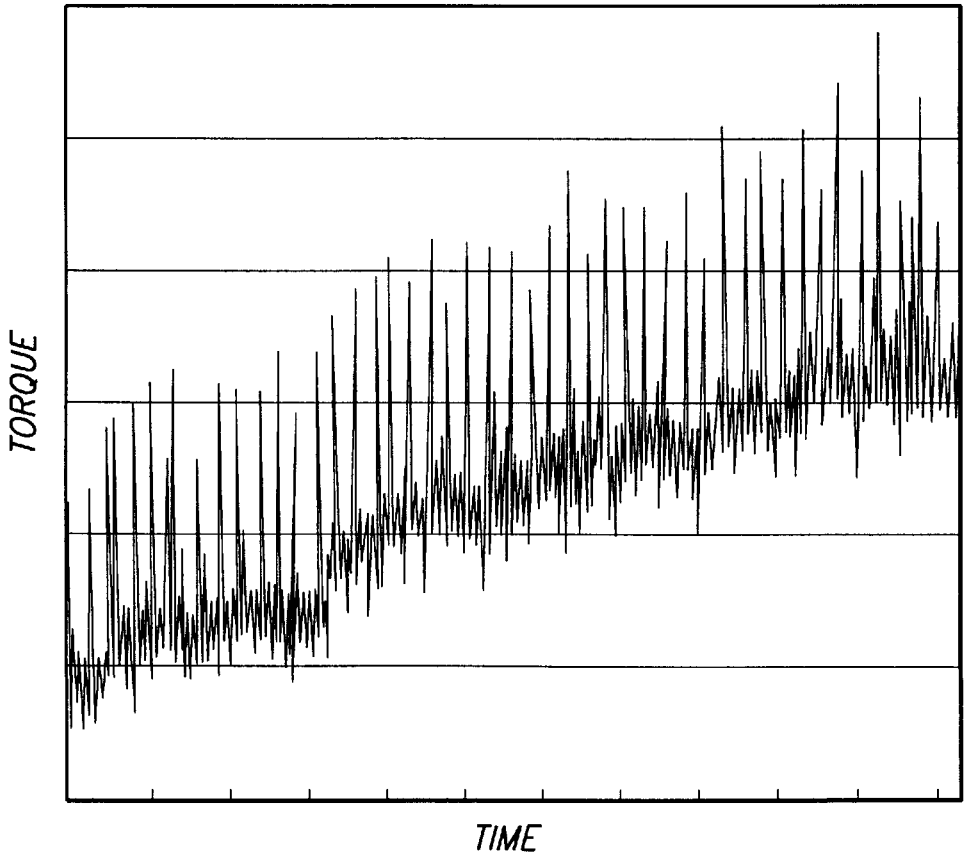
FIG. 4 is a characteristic plot of torque versus time for a printer engine operating in a continuous print mode.

However, investigation has shown that the additional torque required because of mixing paddle 28 is more than offset because of additional torque that is added during usage of a toner cartridge resulting from changes in surface condition on the photoconductive drum 22. More particularly, degradation in the surface condition on photoconductive drum 22 increases the required torque over time more than mixing paddle 28 decreases the torque as toner levels are diminished. FIGS. 3 and 4, described below, comprise attached torque versus time plots which show such increase in torque for two different types of cartridges which have been tested. Such results provide experimental representation of a larger population of toner cartridges presently under test.

As shown in FIGS. 3 and 4, torque was inferred by measuring the current required by drive motor 16 (of FIG. 1), comprising a stepper motor in one embodiment, in order to turn the toner cartridge drive assembly. As can be seen in both FIGS. 3 and 4, the amount of torque generally increases with the number of pages that are printed by a printer, over time.

For example, FIG. 3 illustrates torque versus time for a print job that is being delivered continuously over time. In order to generate a characteristic torque versus time curve, a simple curve is best fit, i.e., least squares curve fit, through the data of FIG. 3 in order to smooth out local fluctuations in the torque versus time curve.

As shown in FIG. 4, torque is plotted versus time for a print engine that is printing in a continuous print mode. Again, a characteristic torque versus time curve is generated by smoothing out the data from FIG. 4 by way of fitting a best-fit curve to the data presented in FIG. 4.

In order to ensure sufficient print quality, the surface condition of the photoconductive drum needs to be clean and not worn out beyond reasonable limits. Presently, the only method available to determine photoconductive drum surface condition is through a calibration technique. Such technique comprises a secondary determination that is made based upon a closed-loop feedback system which adjusts the entire electrophotographic process. However, no specific determination is made which would allow for the troubleshooting of an optical photoconductive drum problem. For the case where print quality is so poor as to be considered a failure, especially for the case where a multicomponent system uses color, a customer is left to change the developer cartridge, toner cartridge, or optical photoconductor cartridge. With the additions of Applicant's invention, an optical photoconductive drum problem can be addressed more directly.

Pursuant to Applicant's invention, the optical photoconductor (OPC) surface condition of a photoconductive drum can be determined without encountering the confounding effects of other electrophotographic parameters where unique measurements need to be made on the surface of the photoconductor. The present method offers a low cost solution, as no additional hardware is required for the printer, and only a small amount of data processing is required on the existing processor. Data processing would include "smoothing" of the torque curves depicted in FIGS. 3 and 4, and comparison of the "smoothed" curve to limits as well as significant changes in shape or behavior.

In addition to detecting wear on an optical photoconductor, Applicant's techniques would enable the detection of contamination present on the surface of the photoconductive drum. Contaminants would cause a change in the general shape of the characteristic torque versus time curve due to interference or lubrication of the photoconductive drum surface. In either case, the user could be warned of potential problems that might result with print quality (PQ) due to improper functioning of the optical photoconductive surface.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An apparatus for detecting the state of a consumable for a printer, comprising:

a consumable cartridge having a rotatable member carried by the cartridge;

a drive motor configured to rotate the rotatable member;

a current measuring device associated with the motor and operative to measure current flow through the motor;

memory including a look-up table configured to store at least one predetermined set of characteristic values of rotatable member torque versus motor current flow for a characteristic consumable cartridge, wherein the at least one characteristic value of current flow corresponds to current flow through the motor and wherein the at least one characteristic value of rotatable member torque is indicative of a change in state of the rotatable member; and processing circuitry coupled with the current measuring device and the memory and operative to determine when the measured current flow corresponds to the predetermined at least one characteristic value of current flow;

wherein the processing circuitry further identifies a state of the consumable cartridge.

2. The apparatus of claim 1 wherein the consumable cartridge comprises a toner cartridge and the rotatable member comprises a developer roll, and the at least one predetermined set of characteristic values comprises a look-up table of values corresponding to a characteristic toner cartridge torque versus current curve.

3. The apparatus of claim 1 wherein the rotatable member comprises a photoconductive drum, and wherein the apparatus further comprises a printing engine operative to render a print job on the photoconductive drum.

4. The apparatus of claim 1 wherein the at least one predetermined set of characteristic values is used to determine a change in use state of the consumable cartridge between a new state and a used state.

5. The apparatus of claim 1 wherein the at least one predetermined set of characteristic values is used to determine a change in surface condition of the rotatable member.

6. The apparatus of claim 1 wherein the processing circuitry evaluates the measured current flow over time to obtain a measured torque versus time curve for a consumable cartridge being used, and wherein the measured torque versus time curve is processed with a smoothing function.

7. An apparatus for detecting the state of a consumable for a printer, comprising:

a consumable cartridge having a rotatable member carried by the cartridge;

a drive motor configured to rotate the rotatable member;

a current measuring device associated with the motor and operative to measure current flow through the motor;

memory configured to store a predetermined value corresponding to current flow through the motor and indicative of a change in state of the rotatable member;

processing circuitry coupled with the current measuring device and the memory and operative to determine when the measured current flow corresponds to the predetermined value of current flow; and at least one drive gear coupled between the rotatable member and the drive motor, the drive gear communicating with a mechanical resistance element such that, during initial use, measured current flow through the motor is caused to be elevated, wherein the processing circuitry further identifies a state of the consumable cartridge.

8. The apparatus of claim 7 wherein the mechanical resistance element comprises a break-away tab associated with the gear and configured to impart mechanical resistance to the gear upon initial use of the consumable cartridge.

9. The apparatus of claim 7 wherein communication of the drive gear with the mechanical resistance element elevates measured current flow through the motor corresponding with a state of the motor that indicates that a new consumable cartridge has been installed in the printer.

10. An apparatus for detecting the operating state of a toner cartridge, comprising:

a drive motor configured to communicate with a developer roll of a toner cartridge engaged for co-rotation with a photoconductive drum, the drive motor operative to rotate the developer roll;

a torque detection device coupled with the motor and operative to measure torque generated by the motor;

a data storage device operative to store at least one target value representative of torque generated by the motor when rotating the developer roll and indicative of a change in operating state of the developer roll; and processing circuitry communicating with the torque detection device and the data storage device and operative to compare the measured torque and the target value of torque to determine when a change in operating state of the developer roll has occurred.

11. The apparatus of claim 10 wherein the at least one target value comprises a look-up table containing data representative of torque versus time values for the drive motor when driving the toner cartridge.

12. The apparatus of claim 10 wherein the at least one target value is indicative of a use state of the toner cartridge, and wherein at least two use states are provided for the toner cartridge including a new state and a used state.

13. An apparatus for detecting the operating state of a toner cartridge, comprising:

a drive motor configured to communicate with a rotatable member of a toner cartridge, the drive motor operative to rotate the rotatable member;

a mechanical resistance element associated with the rotatable member, communicating with the drive motor, and operative to generate an initial increase in torque generated by the drive motor when the toner cartridge is in a new use state;

a torque detection device coupled with the motor and operative to measure torque generated by the motor;

a data storage device operative to store at least one target value representative of torque generated by the motor when rotating the rotatable member and indicative of a change in operating state of the rotatable member; and processing circuitry communicating with the torque detection device and the data storage device and operative to compare the measured torque and the target value of torque to determine when a change in operating state of the rotatable member has occurred.

14. The apparatus of claim 13 wherein at least one drive gear is coupled to the rotatable member, and the mechanical resistance element comprises a break-away tab provided on the toner cartridge and communicating with the drive gear so as to impart mechanical resistance to rotation of the rotatable member and drive motor during initial usage of the toner cartridge.

15. A method of determining the operating state of a replaceable cartridge, comprising the steps of:

providing a drive motor configured to drive in rotation a rotatable member of the cartridge, wherein the rotatable member is engaged in co-rotation with a photoconductive drum, and a current measuring device configured to detect current flow through the drive motor when driving the rotatable member;

detecting current flow through the drive motor with the current measuring device;

comparing the detected current flow with a predetermined value of current flow indicative of a change of operating state for the cartridge, wherein the predetermined value of current flow is indicative of surface condition of the photoconductive drum; and determining surface condition of the photoconductive drum based upon the compared detected current flow and predetermined value of current flow.

16. The method of claim 15 wherein the rotatable member comprises a developer roll.

17. The method of claim 16 further comprising at least one drive gear coupled between the developer roll and the drive motor, the drive gear communicating with a mechanical resistance element such that during initial use, measured current flow through the motor is elevated so as to indicate that a new replacement cartridge has been provided.

* * * * *